United States Patent [19]

Nakanishi et al.

[11] 4,214,979

[45] Jul. 29, 1980

[54] METHOD OF THERMALLY CRACKING HEAVY PETROLEUM OIL

[75] Inventors: Hajime Nakanishi, Fujisawa; Kiyoji Ozaki, Yokohama; Toshio Shinozuka, Kamakura; Masato Izumi, Yokohama; Takaaki Aiba, Ichihara; Hisatsugu Kaji, Ichihara; Yutaka Sumida, Ichihara; Takao Ishihara, Ichihara, all of Japan

[73] Assignees: Kureha Kagaku Kogyo Kabushiki Kaisha, Nihonbashi; Chiyoda Chemical Engineering & Construction Co., Yokohama, both of Japan

[21] Appl. No.: 874,948

[22] Filed: Feb. 3, 1978

[30] Foreign Application Priority Data

Feb. 4, 1977 [JP] Japan ..... 52/010632

[51] Int. Cl.[2] ..... C10G 9/36; C10G 9/12; C10G 9/16

[52] U.S. Cl. ..... 208/128; 208/130; 208/48 R

[58] Field of Search ..... 208/48 R, 72, 75, 106, 208/128, 129, 130, 125, 43, 131

[56] References Cited

U.S. PATENT DOCUMENTS 2,316,931 4/1943 Brandt ..... 208/128

3,344,057 9/1967 Patrick ..... 208/106

3,956,101 5/1976 Hara et al. ..... 208/128

FOREIGN PATENT DOCUMENTS 559863 7/1958 Canada ..... 208/48 R

OTHER PUBLICATIONS

Chatfield, J. C., Produce Salable Fuel Oil on Residuum Run by Making Less Coke, National Petroleum New, Aug. 3, 1927, pp. 83, 84, 87.

*Primary Examiner*—O. R. Vertiz
*Assistant Examiner*—Gary P. Straub
*Attorney, Agent, or Firm*—Stevens, Davis, Miller & Mosher

[57] ABSTRACT

Disclosed herein is a method of thermally cracking a heavy petroleum oil by introducing the heavy petroleum oil into a reactor and contacting the heavy petroleum oil thus introduced with a gas, which does not react with the heavy petroleum oil, at a temperature of 400°-2000° C. thereby thermally cracking the heavy petroleum oil. The method uses plural reactors and introduces the heavy petroleum oil into the reactors in a specified manner, and charges the reactor in advance with a specified amount of heavy petroleum oil of a specified temperature.

3 Claims, 1 Drawing Figure

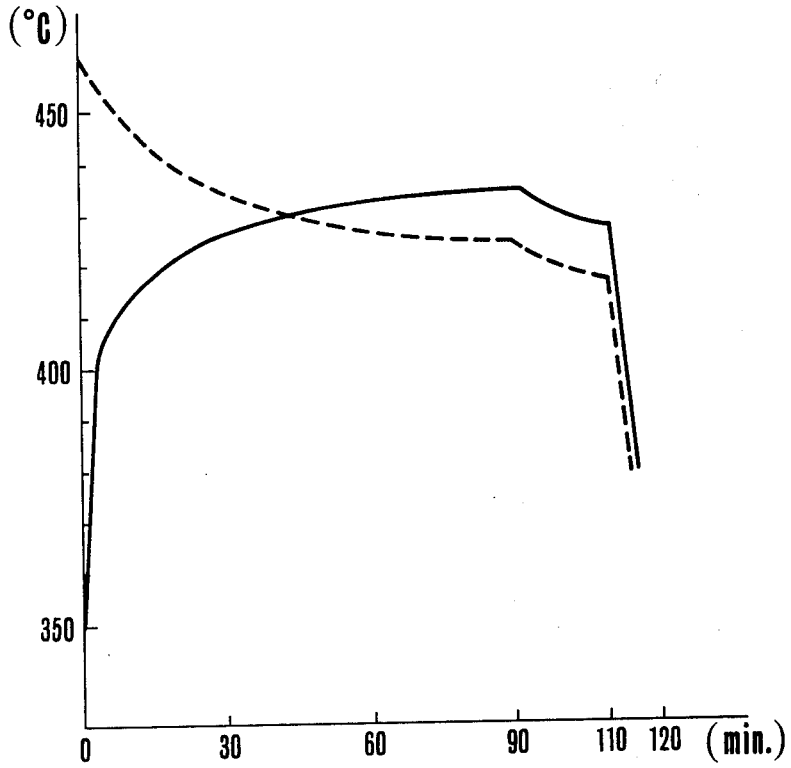
(°C)
450
400
350
0
30
60
90
110
120
(min.)

METHOD OF THERMALLY CRACKING HEAVY PETROLEUM OIL

FIELD OF THE INVENTION

The present invention concerns an advantageous method of thermally cracking a heavy petroleum oil.

BACKGROUND OF THE INVENTION

Hitherto, as one of the methods of thermally cracking a heavy petroleum oil, a method has been proposed in which a gas, which does not react with the heavy petroleum oil, at a temperature of 400°-2000° C., is contacted with the heavy petroleum oil to thermally crack the heavy petroleum oil at a temperature of lower than 500° C., thereby obtaining hydrocarbon gases, aliphatic hydrocarbon oils and aromatic hydrocarbon pitches (e.g., German Offenlegungsschrift No. 2 215 432). In concrete terms, the heavy petroleum oil is heated to a temperature of 450°-520° C. and the thus heated oil is introduced into reactors wherein the oil is contacted with the gas at a temperature of 400°-2000° C. to cause thermal cracking at a temperature of 400°-440° C.

However, according to the above mentioned method, when the heated heavy petroleum oil at a high temperature of 450°-520° C. is introduced into the reactors, an instantaneous contact occurs between the oil and the reactors, producing coke as a by-product and risking heat-shock rupture of the reactors.

SUMMARY OF THE INVENTION

Therefore, an object of the present invention is to provide an effective method of thermally cracking a heavy petroleum oil by using a gas which does not react with the heavy petroleum oil, while the furnace for heating the heavy petroleum oil is operated continuously, by which method the by-production of coke is inhibited and the heat-shock rupture of the reactors is prevented.

This and other objects of the present invention will become clear from the following description.

We have found that where a heavy petroleum oil is thermally cracked by the methods according to prior art described above, the by-production of coke and the heat-shock rupture of the reactors are effectively prevented when a specific amount of the heavy petroleum oil at a specific temperature is introduced in advance into the reactors.

According to the present invention, there is provided a method of thermally cracking a heavy petroleum oil by heating the heavy petroleum oil in a heating furnace, introducing the heavy petroleum oil thus heated into a reactor connected to the furnace, blowing a gas, which does not react with the heavy petroleum oil, at a temperature of 400°-2000° C. into the reactor, and directly contacting the gas with the heavy petroleum oil within the reactor, thereby thermally cracking the heavy petroleum oil in the reactor. The method includes using two or more reactors, continuously and cyclically introducing the heavy petroleum oil from the furnace into the reactors. The feed of the heavy petroleum oil is switched from the first reactor to the second reactor when the introduction of said oil into the first reactor is completed. Each reactor is charged in advance with a heavy petroleum oil portion at a temperature of not more than the reaction temperature and near to the temperature of the reactor itself, before switching the feed for receipt of the heavy petroleum oil from the furnace.

BRIEF DESCRIPTION OF THE DRAWING

The accompanying drawing is a graph which shows the changes of the internal temperature of the reactors with time, when the heavy petroleum oil is introduced into the reactors in advance and when no precharge is used.

DETAILED DESCRIPTION OF THE INVENTION

Heavy petroleum oils which may be treated in accordance with the present invention includes residual oil of distillation under atmospheric pressure, residual oil of distillation under reduced pressure, residual oil of thermal cracking and various kinds of residual oils. The gas to be used for contacting with the heavy petroleum oil, may be any gas stable at a temperature range of 400°-2000° C., not reactive with the heavy petroleum oil and being able to act as a thermal medium, for instance, inert gases such as nitrogen, argon, etc.; steam; and complete combustion gases containing substantially no oxygen.

In the present invention, a specified amount of heavy petroleum oil at a temperature of 300°-350° C. is in advance introduced into the reactors and then additional heavy petroleum oil to be thermally cracked is heated to a temperature of 450°-520° C. and is introduced into the reactors and contacted with the gas at a temperature of 400°-2000° C. for thermal cracking at a temperature of 400°-440° C. In addition, when the temperature of the heavy petroleum oil, which is introduced into the reactors in advance, is higher than 350° C., this precharge itself undergoes thermal cracking, and on the other hand, when it is at a temperature of lower than 300° C., it excessively lowers the temperature of the heavy petroleum oil to be thermally cracked (hereinafter referred to as the raw oil). Therefore, the temperature of the heavy petroleum oil, which is introduced in advance into the reactors, should be kept in a temperature range of 300°-350° C. Furthermore, it is preferable that the amount of the oil precharged at 300°-350° C. is such that the temperature of the heavy petroleum oil content in the reactors is not reduced to lower than 400° C. upon introduction of the raw oil at a temperature of 450°-520° C. in order to carry out the thermal cracking faborably. The above mentioned amount of the oil may be determined in consideration of the temperature of the reactors, that of the raw oil to be introduced and that of the heavy petroleum oil precharge. Actually, the amount of the oil to be charged in advance is 3-30 weight % of the total amount of the oil to be thermally cracked within the reactors, preferably being 5-15 weight %. The temperature of the reactors themselves is preferably kept at 320°-380° C.

For example, the raw oil is first supplied into a heating furnace and heated to a temperature of 450°-520° C. therein, the time of heating being 0.5-15 min, preferably 2-5 min. The thus heated raw oil is introduced into each of a plurality of reactors which already contain an amount of heavy petroleum oil at a temperature of 300°-350° C. The number of reactors is in this case preferably 2 to 4. Introduction of the gas, which is unreactive with the oil, at a temperature of 400°-2000° C. into each reactor is usually carried out by blowing the gas into the bottom of the reactor. At the same time when the raw oil is introduced into the reactor from the heating furnace, the temperature within the reactor comes up to 400°-440° C. and the cracking, which has begun already in the heating furnace, progresses accompanied by polycondensation. Meanwhile, of the products of thermal cracking, gaseous materials leave the top part of the reactor accompanied by the gaseous heating medium. It is preferable to continue the introduction of the gaseous heating medium even after the completion of the introduction of the raw oil, and the reaction still progresses by this procedure. Meanwhile, the reaction temperature is slowly lowered and when the softening point of the pitch product attains the desired value, the reaction can be stopped by cooling internal temperature of the reactor to 320°-380° C.

Soon after the completion of the introduction of the raw oil into the first reactor, the introduction of the raw oil into the second reactor is commenced by the operation of the change-over valve. In the present invention, the standby reactor is charged in advance with an amount of the heavy petroleum oil preheated to a temperature of 300°-350° C. before introducing the raw oil. A reactor may be precharged with the preheated heavy petroleum oil, by splitting off a part of the raw oil on the way from the heating furnace to the reactor, mixing it with heavy petroleum oil at a lower temperature and introducing the thus mixed heavy petroleum oil of a temperature of 300°-350° C. into the reactor, or by introducing an amount of heavy petroleum oil separately preheated to a temperature of 300°-350° C.

By such a preliminary charging of the reactor with an amount of preheated heavy petroleum oil, it is possible to prevent a radical temperature rise within reactor every time introduction of the raw oil is started, to prevent the by-production of coke accompanying the thermal cracking, to improve the quality of the pitch product and and to prevent rupture of the reactor.

As described above, by distilling the volatile oil fractions and the gases from the top of the reactor, is is possible to recover gases and oils of aliphatic hydrocarbons having a H/C ratio (ratio of the number of hydrogen atoms to that of carbon atoms in a molecule) of larger than 1.2 and a pitch of aromatic hydrocarbons having a H/C ratio of less than 1.0 at a high yield.

EXAMPLE

Equal amounts of the residual oils from distillation under a reduced pressure of Kafji crude and of Guchsaran crude were mixed together to be the raw oil of the present invention, the property of the raw oil being presented in the following Table 1.

First, the above mentioned raw oil was passed through a tubular heating furnace at a rate of 300 kg/hr for heating to a temperature of about 490° C. The thus heated raw oil was introduced into a system consisting of two reactors. Each reactor had been charged in advance with 30 kg of the same raw oil at a temperature of 350° C. before the introduction of the raw oil from the heating furnace. The raw oil from the heating furnace was introduced into one of the reactors with flushing for about 90 min and then, by switching a valve the raw oil from the heating furnace was introduced into the other reactor. The thermal cracking was continuously carried out while periodically changing over the feed between the two reactors. In each reactor, the reaction was carried out for about 20 min after introducing the raw oil from the heating furnace. Then, in order to stop the thermal cracking, the reacted material within the reactor was quenched to a temperature of 350° C., and after taking out the pitch product from the reactor, about 30 kg of the above mentioned preheated raw oil at a temperature of 350° C. was again introduced into the reactor as a thermal buffer liquid for placing the reactor in standby for the introduction of the raw oil from the heating furnace. Also, superheated steam was blown into the bottom of the reactor to control the temperature of thermal cracking. The gaseous and oily products of the cracking were distilled off the top of the reactor and were transferred to a separator to be separated into the cracked gas and the cracked oil product.

The operating conditions in this example, the properties of the raw oil, the conditions of heat treatment and the material balance, the properties of the gases and the oils produced by cracking and the properties of the pitch product are presented in Tables 1, 2, 3 and 4, respectively. In addition, the internal temperature of the reactor under the above mentioned conditions of operation is indicated in the accompanying drawing, in which the ordinate represents the internal temperature (in °C.) of the reactor and the abscissa represents the time of reaction (in min). As shown in the drawing, the time period from 0 to 90 min was the time spent for introducing the raw oil into the reactor from the heating furnace, and the time period from 90 to 110 min was the time of reaction within the reactor after the completion of the introduction of the raw oil and then after the lapse of 110 min, the contents of the reactor were quenched and removed. In the drawing, in addition, the solid line represents the case where the raw oil has been introduced in advance into the reactor before the introduction of the raw oil from the heating furnace and the dotted line represents the same case without a precharge.

As seen in the drawing, by charging the reactor with a small amount of the raw oil at a low temperature in the neighbourhood of the temperature of the reactor itself (300°-350° C.), the slope of the rising of the internal temperature of the reactor became relatively gentle. The contamination of the pitch by coke was slight and no occurrence of trouble in the reactor by coke was experienced.

In a case for reference where the reactor was not charged with an amount of the raw oil at a lower temperature in advance, a course represented by the dotted line in the drawing was obtained. The properties of the pitches are shown in Table 4. As clearly seen in the Table 4, when the properties of two pitches are compared, it is understood that the content of quinoline-insoluble matters, which is considered to be the inactive component, is larger in the case where the reactor had not been precharged with the raw oil at a low temperature than in the case where the reactor had been charged in advance with the raw oil at a low temperature, in spite of the facts that both pitches contain nearly the same amount of fixed carbon and are obtained at nearly the same yields. It means that the former is a pitch inferior in uniformity.

Table 1

Properties of the raw oil (a 1 : 1 mixture of the residues of distillation under a reduced pressure of Kafji and Guchsaran crudes)

| Property | Unit | Value |
|---|---|---|
| Specific gravity (15°/4°C.) | — | 1.025 |
| Residual carbon (Conradson) | wt% | 23.0 |
| Softening point | °C. | 48.5 |
| ash content | wt% | 0.15 |
| penetration (ASTM D-5) | — | 78 |

Table 1-continued

| Properties of the raw oil (a 1 : 1 mixture of the residues of distillation under a reduced pressure of Kafji and Guchsaran crudes) | | |
|---|---|---|
| Property | Unit | Value |
| Result of elemental analysis | | |
| C | wt% | 83.2 |
| H | wt% | 10.52 |
| N | wt% | 0.57 |
| S | wt% | 4.34 |
| H/C | — | 1.51 |

Table 2

| Reaction conditions and material balance | |
|---|---|
| Reaction conditions | |
| Rate of supply to the heating furnace | 300 kg/hr |
| Temperature at the outlet of the furnace | 490° C. |
| Number of reactors | 2 |
| Temperature of the raw oil charged in advance | 350° C. |
| Amount of the raw oil charged in advance | 30 kg |
| Time of introducing the raw oil from the heating furnace | 90 min |
| Time reaction after change-over | 20 min |
| Rate of superheated steam while introducing the raw oil | 130 kg/hr |
| Rate of superheated steam after introduction of the raw oil | 40 kg/hr |
| Temperature of the superheated steam | 600° C. |
| Material balance | |
| (represented by yield, wt%) | |
| Gases produced by cracking | 5.2 |
| Light oils produced by cracking | 9.8 |
| Heavy oils produced by cracking | 56.2 |
| Pitch produced by cracking | 28.8 |

Table 3

| Properties of the gas and the oil produced by cracking | | | |
|---|---|---|---|
| Composition of the gas: | | | |
| Name of component | | | Volume % |
| hydrogen | | | 6.4 |
| methane | | | 34.3 |
| ethylene, and ethane | | | 21.2 |
| $C_3H_6$ plus $C_3H_8$ | | | 13.1 |
| $C_4H_8$ plus $C_4H_{10}$ | | | 10.2 |
| larger than $C_5$-hydrocarbons | | | — |
| hydrogen sulfide | | | 10.0 |
| Property of the oil: | | | |
| | | Light oil | heavy oil |
| Specific gravity (15°/4° C.) | | 0.780 | 0.931 |
| Residual carbon (Conradson) | | 0.02 | 1.30 |
| Distill. property | IBP °C. | 40 | 222 |
| | 10% °C. | 77 | 266 |
| | 50% °C. | 147 | 397 |
| | 95% °C. | 219 | 520 |
| Results of elementary analysis: | | | |
| C | wt % | 83.8 | 84.8 |
| H | wt % | 14.65 | 11.65 |
| S | wt % | 1.55 | 3.32 |

Table 3-continued

| Properties of the gas and the oil produced by cracking | | | |
|---|---|---|---|
| H/C | — | 2.10 | 1.65 |

Table 4

| Properties of pitches | With preliminary charging of the raw oil in advance | Without preliminary charging of the raw oil in advance |
|---|---|---|
| Softening point (°C.) | 182 | 180 |
| Fixed carbon (wt%) | 59.1 | 61.0 |
| H/C | 0.83 | 0.81 |
| Insoluble matter in benzene (wt%) | 53.8 | 54.2 |
| Insoluble matter in quinoline (wt%) | 18.6 | 20.7 |

What is claimed is:

1. In a method of thermally cracking a heavy petroleum oil by heating said heavy petroleum oil to a temperature of 450° to 520° C. in a first furnace and introducing the thus heated heavy petroleum oil into a reactor wherein said heated heavy petroleum oil is brought into contact with an unreactive gas at a temperature of 400° to 2,000° C., thereby thermally cracking said heated heavy petroleum oil at a reaction temperature of 400° to 440° C., the improvement comprising:

(a) using two or more of said reactors;

(b) heating a portion of said heavy petroleum oil to a temperature of 300° to 350° C. in a second furnace;

(c) precharging alternatively each reactor with the heated oil from step (b), said portion of oil in step (b) corresponding to 3 to 30% by weight of said heavy petroleum oil to be thermally cracked within said reactor, prior to the introduction of said heated heavy petroleum oil at a temperature of 450° to 520° C., and keeping the thus precharged heavy petroleum oil at a temperature of 300° to 350° C. within said reactor; and (d) alternatively feeding said heated heavy petroleum at a temperature of 450° to 520° C. from said first furnace into said reactors containing said precharged portion of said heavy petroleum oil kept at a temperature of 300° to 350° C., and switching the feed from the first reactor to the second reactor when the introduction of said heated heavy petroleum oil at a temperature of 450° to 520° C. into said first reactor is completed, whereby the formation of coke as a byproduct and the rupture of the reactor as a result of a radical temperature rise are prevented.

2. The method according to claim 1, wherein said amount of said heavy petroleum oil which is precharged into each reactor in step (c) is in the range of 5–15% by weight of the amount of said heavy petroleum oil to be thermally cracked within said reactor.

3. The method according to claim 1, wherein the number of said reactors is in the range of from 2 to 4.

* * * * *